US005765653A

United States Patent [19]

Doster et al.

[11] Patent Number: 5,765,653

[45] Date of Patent: Jun. 16, 1998

[54] REAMING APPARATUS AND METHOD WITH ENHANCED STABILITY AND TRANSITION FROM PILOT HOLE TO ENLARGED BORE DIAMETER

[75] Inventors: Michael L. Doster, Spring; Rudolf C. O. Pessier, Houston; David M. Schnell; Bart T. McDonald, both of The Woodlands, all of Tex.

[73] Assignee: Baker Hughes Incorporated, Houston, Tex.

[21] Appl. No.: 727,879

[22] Filed: Oct. 9, 1996

[51] Int. Cl.[6] ..... E21B 7/08

[52] U.S. Cl. ..... 175/75; 175/385; 175/398

[58] Field of Search ..... 175/334, 385, 175/391, 398, 431, 61, 75, 76

[56] References Cited

U.S. PATENT DOCUMENTS

| | | | |
|---|---|---|---|
| 1,769,921 | 7/1930 | Hansen . | |
| 1,959,368 | 5/1934 | Kennedye . | |
| 2,045,629 | 6/1936 | Bettis . | |
| 2,308,147 | 1/1943 | Ballagh . | |
| 2,671,641 | 3/1954 | Hinkle . | |
| 2,715,552 | 8/1955 | Lane . | |
| 2,877,062 | 3/1959 | Hall et al. . | |
| 3,588,199 | 6/1971 | Hopmans . | |
| 3,942,824 | 3/1976 | Sable . | |
| 4,080,010 | 3/1978 | Young . | |
| 4,580,642 | 4/1986 | Gosch . | |
| 4,600,063 | 7/1986 | Beasley . | |
| 4,610,307 | 9/1986 | Jurgens et al. . | |
| 4,630,690 | 12/1986 | Beasley et al. . | |
| 4,630,694 | 12/1986 | Walton et al. | 175/391 |
| 4,693,328 | 9/1987 | Furse et al. | 175/275 |
| 4,698,794 | 10/1987 | Kruger et al. . | |
| 4,729,438 | 3/1988 | Walker et al. . | |
| 4,739,842 | 4/1988 | Kruger et al. . | |
| 4,807,708 | 2/1989 | Forrest et al. . | |
| 4,817,740 | 4/1989 | Beimgraben . | |
| 4,854,403 | 8/1989 | Ostertag et al. . | |
| 4,984,633 | 1/1991 | Langer et al. . | |
| 5,050,692 | 9/1991 | Beimgraben . | |
| 5,094,304 | 3/1992 | Briggs . | |
| 5,099,931 | 3/1992 | Krueger et al. . | |

(List continued on next page.)

OTHER PUBLICATIONS

Csonka, G., et al. "Ream While Drilling Technology Applied Successfully Offshore Australia", *SPE International*, pp. 271–278, Oct. 1996.

Le Blanc, Leonard, "Reaming–While–Drilling Keys Effort To Reduce Tripping Of Long Drillstrings", *Offshore*, pp. 30–32, Apr. 1996.

Myhre, K., "Application Of Bicenter Bits In Well–Deepening Operations", *SPE International*, pp. 131–137, Mar. 2, 1990.

Rothe, Jorge Rodriquez, et al, "Reaming–While–Drilling Tool Cuts Costs Of Three Venezuelan Wells", *Oil & Gas Journal*, pp. 33–40, Jan. 13, 1997.

Sketchler, B.C., "New Bi–Center Technology Proves Effective In Slim Hole Horizontal Well", *SPE International*, pp. 559–567, Mar. 1995.

Warren, T.M., et al, "Simultaneous Drilling And Reaming With Fixed Blade Reamers", pp. 1–11, Oct. 22–25, 1995.

Casto, Robert G., et al, "Use of bicenter PDC bit reduces drilling cost", *Oil & Gas Journal*, pp. 92–96, Nov. 13, 1995.

*Primary Examiner*—Frank Tsay
*Attorney, Agent, or Firm*—Trask, Britt & Rossa

[57] ABSTRACT

A method and apparatus for reaming or enlarging a borehole with enhanced stability. A pilot stabilization pad (PSP) having an axially and circumferentially tapered entry surface and a circumferential transition surface above is employed to enhance the transition from the smaller diameter borehole to be enlarged while accommodated the side force vector generated by the cutting assembly used to effect the enlargement. In addition, one or more eccentric stabilizers are employed above the reaming apparatus to laterally or radially stabilize the bottomhole assembly, which may comprise either a straight-hole or steerable, motor-driven assembly.

48 Claims, 6 Drawing Sheets

U.S. PATENT DOCUMENTS

| | | | |
|---|---|---|---|
| 5,150,757 | 9/1992 | Nunley . | |
| 5,180,021 | 1/1993 | Champion et al. . | |
| 5,213,168 | 5/1993 | Warren et al. | 175/61 |
| 5,222,565 | 6/1993 | Collinsworth . | |
| 5,307,885 | 5/1994 | Kuwana et al. . | |
| 5,363,931 | 11/1994 | Moriarty . | |
| 5,368,114 | 11/1994 | Tandberg et al. | 175/267 |
| 5,437,342 | 8/1995 | Powada . | |
| 5,465,759 | 11/1995 | Carlson et al. . | |
| 5,474,143 | 12/1995 | Majkovic . | |
| 5,495,899 | 3/1996 | Pastusek et al. . | |
| 5,497,842 | 3/1996 | Pastusek et al. . | |
| 5,522,467 | 6/1996 | Stevens et al. . | |
| 5,542,454 | 8/1996 | Carlson et al. . | |
| 5,678,644 | 10/1997 | Fielder . | |

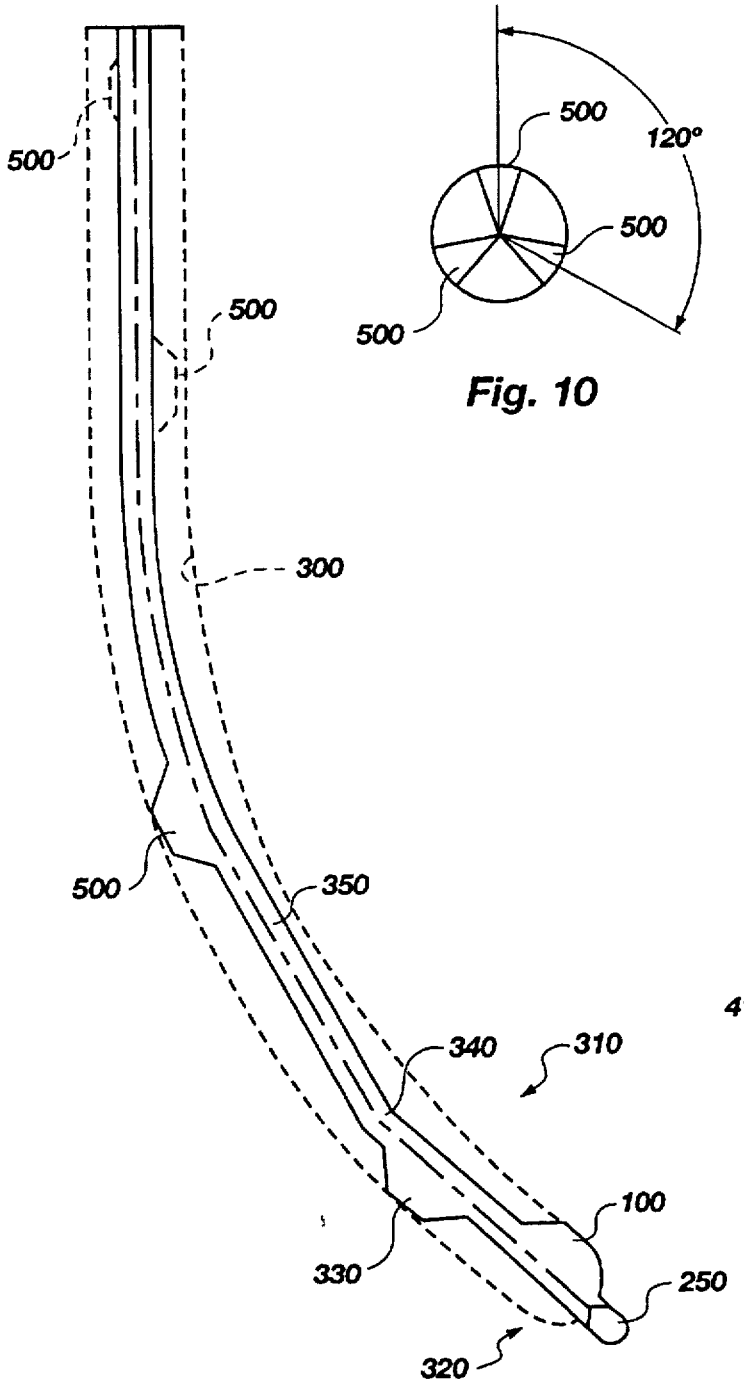
Fig. 8
Fig. 10
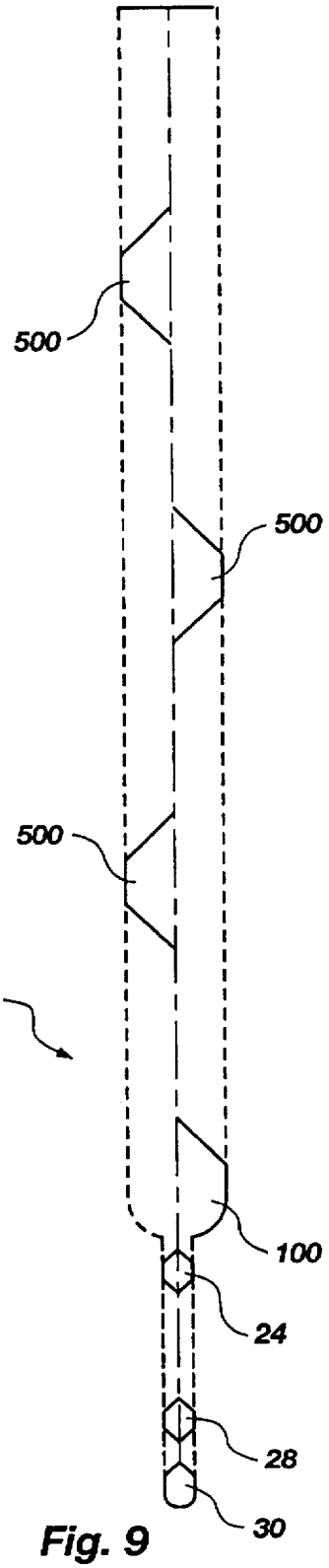
Fig. 9

REAMING APPARATUS AND METHOD WITH ENHANCED STABILITY AND TRANSITION FROM PILOT HOLE TO ENLARGED BORE DIAMETER

BACKGROUND OF THE INVENTION

1. Field of the Invention

The present invention relates generally to enlarging the diameter of a subterranean borehole, and more specifically to enlarging the borehole below a portion thereof which remains at a lesser diameter. The method and apparatus of the present invention effects such enlargement with enhanced stability of the bottomhole assembly, including a smoother and more controlled transition from the smaller, pilot hole, which may or may not comprise the pass through diameter, to the enlarged bore diameter.

2. State of the Art

It is known to employ both eccentric and bi-center bits to enlarge a borehole below a tight or undersized portion thereof.

An eccentric bit includes an extended or enlarged cutting portion which, when the bit is rotated about its axis, produces an enlarged borehole. An example of an eccentric bit is disclosed in U.S. Pat. No. 4,635,738.

A bi-center bit assembly employs two longitudinally-superimposed bit sections with laterally offset axes. The first axis is the center of the pass through diameter, that is, the diameter of the smallest borehole the bit will pass through. This axis may be referred to as the pass through axis. The second axis is the axis of the hole cut as the bit is rotated. This axis may be referred to as the drilling axis. There is usually a first, lower and smaller diameter pilot section employed to commence the drilling and rotation of the bit is centered about the drilling axis as the second, upper and larger diameter main bit section engages the formation to enlarge the borehole, the rotational axis of the bit assembly rapidly transitioning from the pass through axis to the drilling axis when the full diameter, enlarged borehole is drilled.

Rather than employing a one-piece drilling structure such as an eccentric bit or a bi-center bit to enlarge a borehole below a constricted or reduced-diameter segment, it is also known to employ an extended bottomhole assembly (extended bi-center assembly) with a pilot bit at the distal end thereof and a reamer assembly some distance above. This arrangement permits the use of any standard bit type, be it a rock bit or a drag bit, as the pilot bit, and the extended nature of the assembly permits greater flexibility when passing through tight spots in the borehole as well as the opportunity to effectively stabilize the pilot bit so that the pilot hole and the following reamer will take the path intended for the borehole. This aspect of an extended bottomhole assembly is particularly significant in directional drilling.

While all of the foregoing alternative approaches can be employed to enlarge a borehole below a reduced-diameter segment, the pilot bit with reamer assembly has proven to be the most effective overall. The assignee of the present invention has, to this end, designed as reaming structures so-called "reamer wings" in the very recent past, which reamer wings generally comprise a tubular body having a fishing neck with a threaded connection at the top thereof, and a tong die surface at the bottom thereof, also with a threaded connection. The upper mid-portion of the reamer wing includes one or more longitudinally-extending blades projecting generally radially outwardly from the tubular body, the outer edges of the blades carrying superabrasive (also termed superhard) cutting elements, commonly termed PDC's (for Polycrystalline Diamond Compacts). The lower mid-portion of the reamer wing may include a stabilizing pad having an arcuate exterior surface of the same or slightly smaller than the radius of the pilot hole on the exterior of the tubular body and longitudinally below the blades. The stabilizer pad is characteristically placed on the opposite side of the body with respect to the reamer wing blades so that the reamer wing will ride on the pad due to the resultant force vector generated by the cutting of the blade or blades as the enlarged borehole is cut.

While the aforementioned reamer wing design enjoyed some initial success, it was recognized that the device as constructed might not effectively and efficiently address the problem or task of achieving a rapid transition from pass through to full hole or "drill" diameter which closely tracks the path of the pilot bit and which does not unduly load the blades or bottomhole assembly during the transition. Since a reamer wing may have to re-establish a full diameter borehole multiple times during its drilling life in a single borehole, due to washouts and doglegs of the pilot hole, a rapid transitioning ability when reaming is re-started as well as a robust design which can accommodate multiple transitions without significant damage was recognized as a desirable characteristic and design modification. U.S. Pat. No. 5,497,842, assigned to the assignee of the present invention and incorporated herein for all purposes by this reference, discloses the use of so-called "secondary" blades on the reamer wing to speed the transition from pass through to drill diameter with reduced vibration and borehole eccentricity.

While the improvement of the '842 patent has proven significant, it has been recognized by the inventors herein that further improvements in the overall stability of the bottomhole assembly, including transitioning from pass through to drill diameter, would be highly desirable. One problem the prior art reamer assembly designs have experienced is undue vibration and even so-called bit "whirl," despite the focused or directed force vector acting on the reaming assembly and the presence of the stabilization pad. These undesirable phenomena appear to be related to the configuration of the stabilization pad (illustrated in FIG. 5 of the '842 patent), which engages the borehole wall axially and circumferentially under the radially-directed resultant force vector of the reamer wing as the assembly drills ahead in the pilot hole, due to the pad's abrupt radial projection from the reamer wing body. Furthermore, it has been observed that the entire bottomhole reaming assembly as employed in the prior art for straight-hole drilling with a rotary table or top drive often experiences pipe "whip" due to lack of sufficient lateral or radial stabilization above the reamer wing. In addition, reaming assemblies driven by downhole steerable motors for so-called directional or navigational drilling have experienced problems with stability under the lateral forces generated by the reamer wing so as to make it difficult to maintain the planned borehole trajectory.

In order to provide the reader with a better understanding of the problems associated with prior art reaming assemblies and to better appreciate the advantages of the present invention, FIGS. 1 through 3 herein depict an exemplary prior art bi-center bottomhole assembly 10 in which the reamer wing disclosed in U.S. Pat. No. 5,497,842 is employed.

Commencing with FIG. 1 and moving from the top to the bottom of the assembly 10, one or more drill collars 12 are suspended from the distal end of a drill string extending to the rig floor at the surface. Pass through stabilizer (optional) 14 is secured to drill collar 12, stabilizer 14 being sized equal to or slightly smaller than the pass through diameter of the bottomhole assembly 10, which may be defined as the smallest diameter borehole through which the assembly may move longitudinally. Another drill collar 16 (or other drill string element such as an MWD tool housing or pony collar) is secured to the bottom of stabilizer 14, below which reamer wing 100 including a stabilization pad 118 is secured via tool joint 18. Another API joint 22 is located at the bottom of the reamer wing 100. An upper pilot stabilizer 24, secured to reamer wing 100, is of an O.D. equal to or slightly smaller than that of the pilot bit at the bottom of the assembly 10. Yet another, smaller diameter drill collar 26 is secured to the lower end of pilot stabilizer 24, followed by a lower pilot stabilizer 28 to which is secured pilot bit 30. Pilot bit 30 may be either a rotary drag bit or a tri-cone, so-called "rock bit". The bottomhole assembly as described is exemplary only, it being appreciated by those of ordinary skill in the art that many other assemblies and variations may be employed.

It should be noted that there is an upper lateral displacement 32 between the axis of pass through stabilizer 14 and that of reamer wing 100, which displacement is provided by the presence of drill collar 16 therebetween and which promotes passage of the assembly 10, and particularly the reamer wing 100, through a borehole segment of the design pass through diameter.

For purposes of discussion, the following exemplary dimensions may be helpful in understanding the relative sizing of the components of the assembly for a particular pass through diameter, pilot diameter and drill diameter. For a pass through diameter of 10.625 inches, a pilot diameter of 8.500 inches and a maximum drill diameter of 12.250 inches (the full bore diameter drilled by reamer wing 100) would normally be specified. In the bottomhole assembly 10, for the above parameters:

(a) drill collar 12 may be an eight inch drill collar;

(b) drill collar 16 may be a thirty foot, eight inch drill collar;

(c) drill collar 26 may be a fifteen foot, 6 ¾ inch drill collar; and (d) pilot bit 30 is an 8 ½ inch bit.

In pass through condition, shown in FIG. 1, the assembly 10 is always in either tension or compression, depending upon the direction of travel, as shown by arrow 34. Contact of the assembly with the borehole wall 50 is primarily through pass through stabilizer 14 and reamer wing 100. The assembly 10 is not normally rotated while in pass through condition.

FIG. 2 depicts start up condition of assembly 10, wherein assembly 10 is rotated by application of torque as shown by arrow 36 as weight-on-bit (WOB) is also applied to the string, as shown by arrow 38. As shown, pilot bit 30 has drilled ahead into the uncut formation to a depth approximating the position of upper pilot stabilizer 24, but reamer wing 100 has yet to commence enlarging the borehole to drill diameter. As shown at 32 and at 40, the axis of reamer wing 100 is laterally displaced from those of both pass through stabilizer 14 and upper pilot stabilizer 24. In this condition, the reamer wing 100 has not yet begun its transition from being centered about a pass through center line to its drilling mode center line which is aligned with that of pilot bit 30.

FIG. 3 depicts the normal drilling mode of bottomhole assembly 10, wherein torque 36 and WOB 38 are applied. Upper displacement 32 may remain as shown, but generally is eliminated under all but the most severe drilling conditions. Lower displacement 40 has been eliminated as reamer wing 100 is rotating about the same axis as pilot bit 30 in cutting the borehole to full drill diameter. It is readily apparent from FIG. 3 that concentric stabilizer 14 (if employed) performs only a nominal stabilization function once enlargement of the borehole is fully underway and stabilizer 14 has passed into the enlarged segment of the borehole. In such circumstances, the aforementioned drill string "whip" is experienced due to effective contact of the string with the borehole wall being limited to only one lateral or radial location.

It is also known to employ expandable concentric stabilizers to effect better stabilization of the bottomhole assembly in the enlarge borehole, the diameter of which stabilizers may be increased by string manipulation or hydraulically once the stabilizer has reached an enlarged portion of the borehole, one such device being disclosed in U.S. Pat. No. 4,854,403, assigned to the assignee of the present invention. Such devices, however, are relatively complex and expensive, and may fail to contract after expansion, impeding or preventing the trip out of the borehole.

It is also readily apparent from FIG. 3 that prior art stabilization pad 118 of the configuration as previously described is forced into the wall of the pilot hole, thus engaging it both axially and circumferentially as the assembly rotates and follows the pilot bit, promoting unwanted vibration and possibly inducing whirl of the assembly.

SUMMARY OF THE INVENTION

The present invention provides improved axial entry and circumferential transition between pass through and drill diameter for a ream while drilling (RWD) tool, also termed a "reamer wing," as well as improved radial stability of both rotary table-driven and downhole motor-driven bottomhole reaming assemblies.

One aspect of the invention comprises a pilot stabilization pad (PSP) with an axially and circumferentially tapered arcuate lower entry surface of increasing diameter as it extends upwardly and away from the direction of bit rotation, in combination with a contiguous circumferentially tapered arcuate transition surface gradually extending to a greater diameter opposite the direction of tool rotation. The PSP is typically employed immediately below the blades of the RWD tool, so as to best focus the lateral force vector of the former against the borehole wall without a tendency to tilt or cant the assembly (which would be experienced if the PSP was some distance below the blades. The axial and circumferential tapers of the lead or entry surface of the PSP intimately engage the wall of the borehole cut by the pilot bit below the PSP over a large circumferential segment in the region of the force vector generated by the RWD tool as the tool enters the pilot borehole, smoothing and speeding the entry. The circumferential transition surface of the PSP immediately above the entry surface maintains the intimate borehole wall contact as the RWD tool enlarges the borehole, directing the lateral loading generated by the tool to a stable location on the PSP. The prior art stabilization pad, as noted above, employed neither a tapered entry or circumferential surface, literally comprising a "pad" projecting radially from the tool body and resulting in undue vibration of the assembly and a tendency for the assembly to "whirl" under particularly adverse conditions due to its aggressive contact with the borehole wall.

In another aspect of the invention, one or more eccentric stabilizers are placed in or above the bottomhole reaming assembly to permit ready passage thereof through the pilot hole or pass through diameter, while effectively radially stabilizing the assembly during the hole-opening operation thereafter. If more than one eccentric stabilizer is employed, such as in a rotary drilling mode, some or all of the multiple stabilizers may be substantially mutually rotationally offset, as well as longitudinally spaced with stands of drill pipe or drill collars therebetween, rotational offset of the stabilizers ensuring engagement of the borehole wall at different circumferential locations, and the wide longitudinal spacing ensuring ready passage of the various stabilizers through the pass through portion of the borehole by providing adequate drill string lateral flex therebetween.

BRIEF DESCRIPTION OF THE DRAWINGS

FIG. 8 is a schematic depiction of an exemplary steerable bottomhole reaming assembly employing an eccentric stabilizer in accordance with the present invention;

FIG. 9 is a schematic depiction of an exemplary rotary bottomhole reaming assembly employing a plurality of eccentric stabilizers in accordance with the present invention;

FIG. 10 is a top view showing rotational placement of the eccentric stabilizers of FIG. 9;

DETAILED DESCRIPTION OF THE PREFERRED EMBODIMENT

Figure 4:
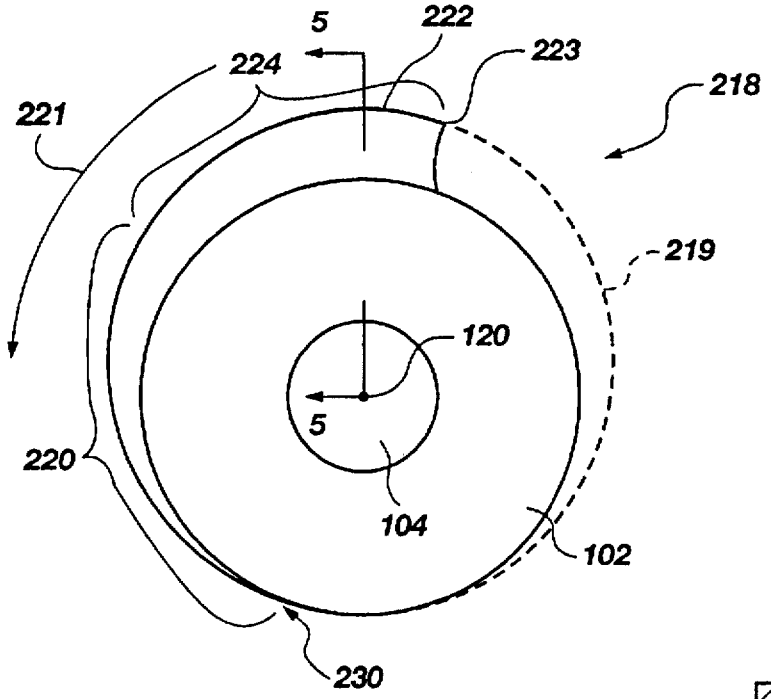
FIG. 4 comprises a bottom elevation of an exemplary PSP in accordance with the present invention.
Figure 5:
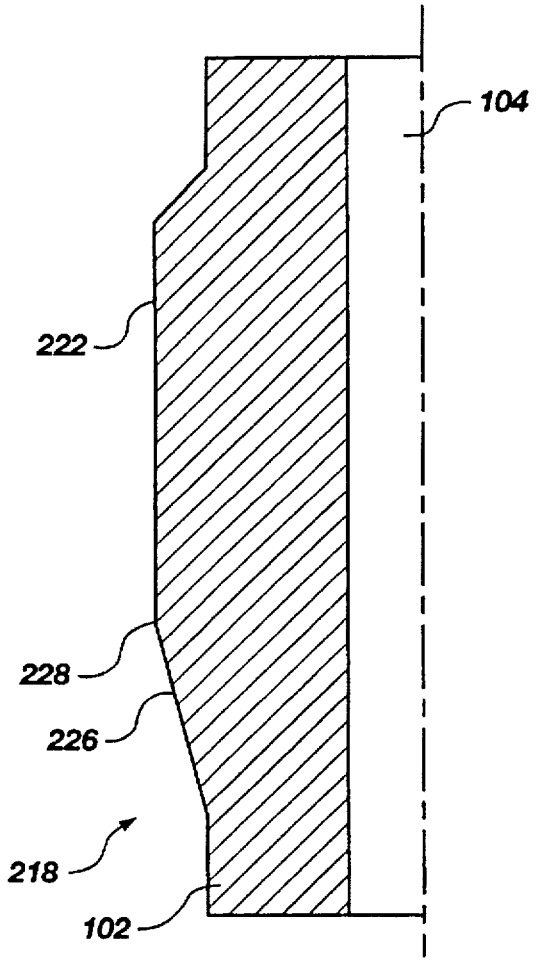
FIG. 5 comprises a side quarter-sectional elevation of the exemplary PSP of FIG. 4, taken along line 5—5.

FIGS. 4 and 5 depict a PSP 218 according to the present invention, for clarity without reference to other elements of the RWD tool in which the PSP is employed. PSP 218 is typically mounted to or formed as a part of a tubular body 102 having a concentric bore 104 extending therethrough, bore 104 communicating drilling fluid to the pilot bit employed with the RWD tool. As shown in FIG. 4, a bottom view, the lateral dimensions of the PSP, transverse to the longitudinal axis, render it capable of longitudinally moving through pilot hole 219, shown in broken lines. It will also be appreciated (as illustrated) that the respective leading portion 220 (taken in the direction of rotation 221) of transition surface 222 of PSP may closely approximate the radius of curvature of pilot hole 219, while the trailing portion 224 remains at a constant, slightly smaller radius from centerline 120 of tool body 102. In any case, transition surface 222 may be said to increase its radial projection from body 102 from its leading edge 220 to its trailing edge 223. While transition surface 222 extends substantially longitudinally, parallel to the axis of the RWD tool body from which PSP 218 projects, it will be appreciated that the entry surface 228 tapers outwardly in a longitudinally upward direction from the tool body to meet transition surface 222 along boundary 228, the longitudinal extent of entry surface 226 increasing away from the leading edge 230 of PSP. The angle of taper relative to the tool axis is preferably constant, and may preferably range from about 10° to about 45°, with the most preferred taper angle currently believed to be about 20°. Entry surface 226 and transition surface 222 of PSP 218 may be hardfaced as desired, such as by plasma spray or welding of WC bricks or brazing of diamond-impregnated segments thereto, as known in the stabilizer art. However, it has been demonstrated in laboratory testing that wear of the surfaces 222 and 226 is beneficial, conforming the exterior of the PSP more closely to the actual borehole wall topography and thus providing additional bearing area as well as further reducing the likelihood of detrimental vibrations and bit whirl.

Figure 6:
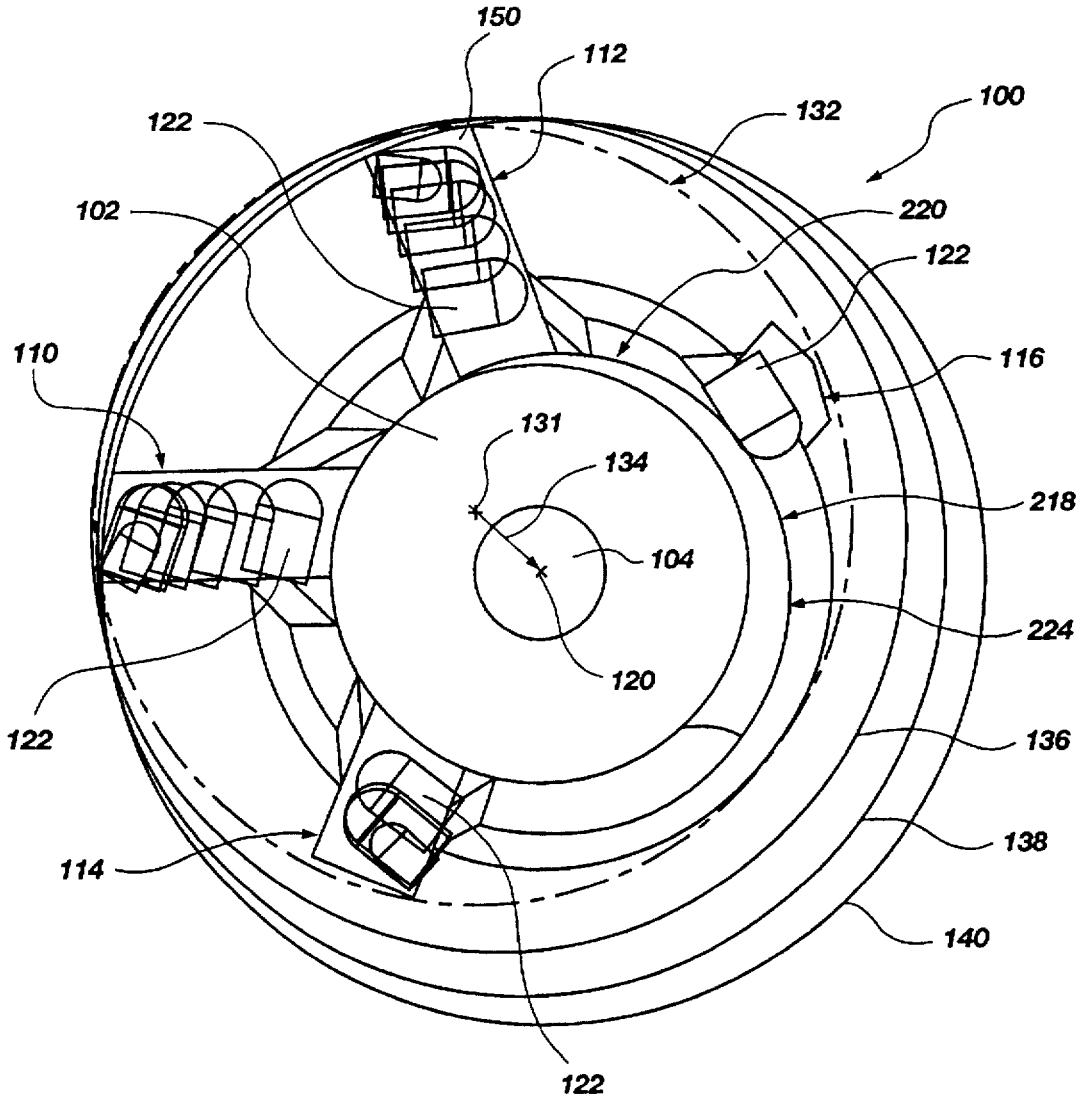
FIG. 6 comprises an enlarged bottom elevation of an exemplary RWD tool showing the PSP according to the present invention.

FIG. 6 illustrates an exemplary reamer wing or RWD tool 100 including PSP 218 according to the present invention. Reamer wing 100 comprises a tubular body 102 having an axial bore 104 therethrough. Reamer wing 100 may be secured in a bottomhole assembly such as 10, described above, or assemblies 310 or 410, as subsequently described, via API threaded connections of the type previously indicated.

Circumferentially-spaced primary blades 110 and 112 and secondary blades 114 and 116 extend longitudinally and generally radially from body 102. Body 102 and blades 110–116 are preferably formed of steel, and the blades may be integral or welded to the body. It should be noted that the number of blades depicted is exemplary only, and that as many as five or more blades may be employed on a reamer wing or RWD tool according to the invention, the larger the required diameter of the enlarged borehole, the larger number of blades being generally dictated. As desired or required, one or more passages (not shown) may extend from bore 104 to the surface of body 102 to direct drilling fluid to the blades and cutting elements thereon via nozzles (not shown), such technology being well known in the drilling art.

PSP 218 is located on the lower portion of body 102 generally diametrically opposite in location to primary blades 110 and 112 and closely therebelow. The body 102 on which PSP 218 is located may comprise the same body on which blades 110–116 are located, or may comprise a separate sub, as desired. As previously noted with respect to FIG. 4, leading portion 220 of transition surface 222 of PSP 218 is provided with an arcuate exterior longitudinal surface which is of greater radius than that of tubular body 102, such arc being drawn from a point laterally offset from the centerline 120 of tubular body 102, while arcuate trailing portion 224 of transition surface 222 is of slightly smaller and concentric with centerline 120. As previously implied, circumferential placement of PSP 218 is dictated by the resultant lateral force vector generated by the blades during transition from start up condition to and during drilling of the drill diameter hole so that the pad rides on the borehole wall as the blades cut the transition and ultimate drill diameter. Contrary to prior art beliefs, even if the RWD tool is employed with a steerable bottomhole assembly, PSP 218 provides notable stabilization benefits. As shown in FIG. 6, primary blades 110 and 112 extend radially outward from drilling axis or centerline 120 a greater distance than secondary blades 114 and 116. It can be seen that both primary and secondary blades carry cutting elements 122 at their lower and radially inner extents which will continue to actively cut after full drill diameter is reached. However, due to the radially smaller extent of the secondary blades, cutting elements on the flank of secondary blade 114 will only cut during the transition from start up to full drill diameter, after which they will no longer contact the borehole sidewall, at which time the cutting elements on primary blades 110 and 112 will still be active. In other words, a major function of secondary blade 114 is to effectuate as rapid and smooth transition as possible to full drill diameter by permitting reamer wing 100 to remove more formation material per revolution and with lower side reaction forces and thus less lateral disruption of assembly rotation than if only primary blades were employed.

Figure 3:
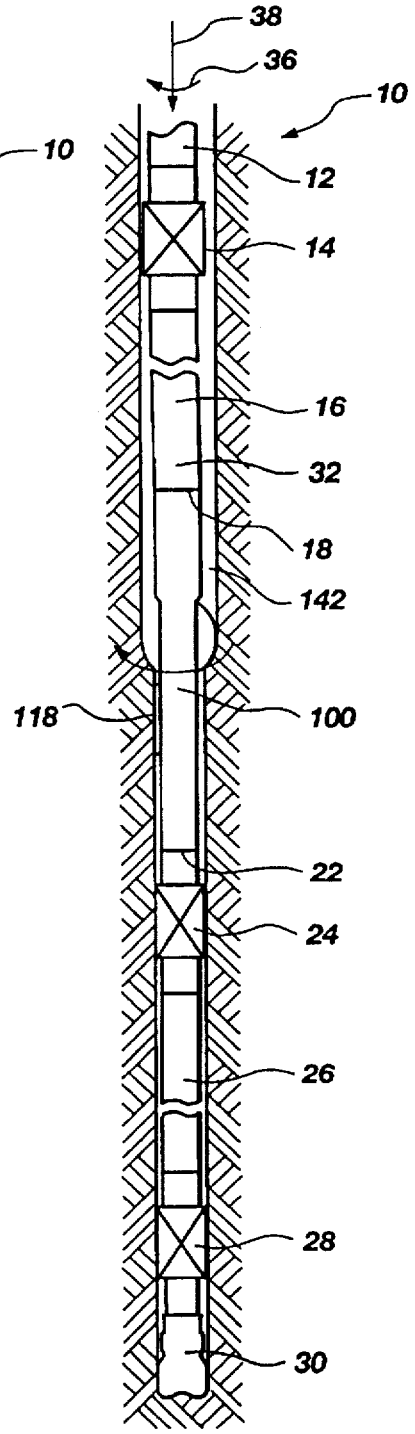
Fig. 3 (PRIOR ART)

Looking specifically to FIG. 6, the various operational stages of RWD tool 100 can be related to pass through and drill diameters, pass through and drill centerlines, and the transition therebetween. Pass through centerline 130 is the centerline of the pass through diameter 132, the smallest diameter through which reamer wing 100 may pass longitudinally. As the bottomhole assembly is placed in operation, with torque and WOB applied, RWD tool 100 is rotated about a centerline which begins to shift from 130 to 120 along transition line 134, which is not stationary but obviously rotates as reamer wing 100 itself rotates. As can readily be seen from FIG. 5, at commencement of rotation the presence of secondary blade 114 provides a balance to the cutting forces acting on reamer wing 100 and thus reduces vibration tendencies and impact on the cutting elements. Circles 136 and 138 illustrate the progression from pass through to drill diameter at the half and three-quarters open stages. Circle 140 illustrates full drill diameter, which is drilled about centerline 120 by primary blades 110 and 112. During drilling of the drill diameter, PSP 218 will ride against the pilot bit-sized borehole wall below the enlarged borehole segment 142 drilled by primary blades 110 and 112 (see FIG. 3 for stabilizer pad position in pilot hole). While the face and lower flank cutting elements of all the blades are in continuous engagement with the formation, neither of the secondary blades 114 and 116 or any other portion of reamer wing 100 except for the primary blades 110 and 112 will normally contact the borehole sidewall during drilling after the borehole is enlarged to drill diameter. While not so readily apparent, it will also be appreciated that trailing primary blade 112 will not be engaged with the formation until drill diameter is reached and the reamer wing 100 is rotating about center-line 120.

Figure 7:
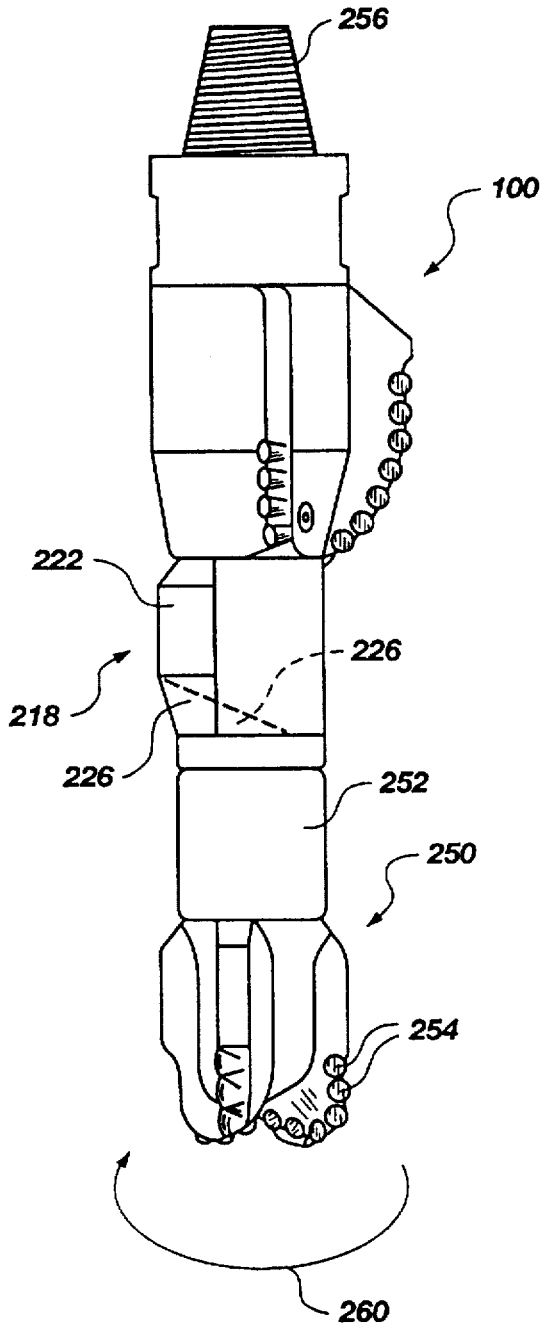
FIG. 7 comprises a side elevation of an RWD tool in combination with a pilot bit in an arrangement such as might be employed in a steerable RWD assembly, showing the lower entry surface and circumferential transition surface of the PSP.

Referring now to FIG. 7 of the drawings, reamer wing 100 with PSP 218 is depicted arranged above a pilot bit 250 with only a short pilot sub 252 interposed between PSP 218 and bit 250. Bit 250 as shown is a rotary drag bit employing PDC cutters 254, although as previously noted a tri-cone or "rock bit" pilot bit may also be employed, as desired. The top of reamer wing 100 comprises a pin connection 256 for threading to the output shaft of a downhole motor bearing housing (not shown), the motor typically being a positive-displacement or Moineau-type drilling fluid-driven motor as known in the art. As shown in broken lines in FIG. 7, entry surface 226 of PSP 218 gradually increases in longitudinal extent opposite to the direction of rotation 260 of the assembly.

Figure 7A:
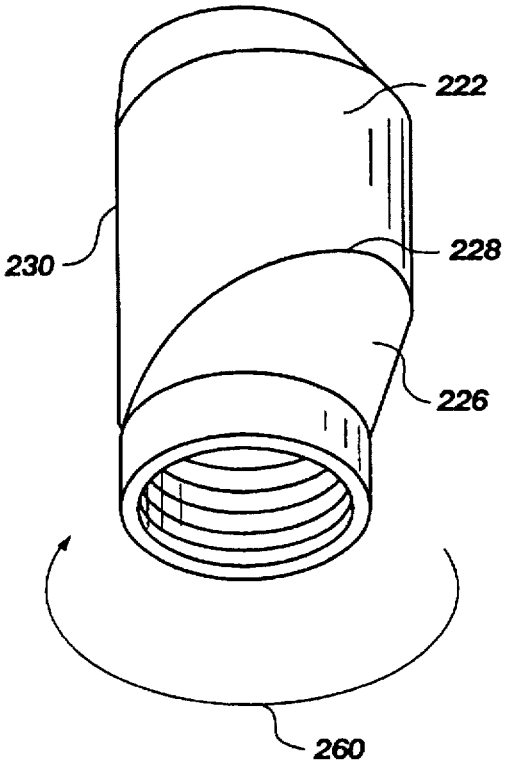
FIG. 7A is a perspective view of the opposite side of the PSP of FIG. 7, showing the leading portions of the lower entry surface and circumferential transition surface of the PSP.

The configuration of entry surface 226 and the nature of the boundary line 228 with transition surface 222 may be better appreciated by reference to FIG. 7A, showing the back side of PSP 218 as oriented in FIG. 7. Laboratory tests, wherein entry surface 226 and transition surface 222 were covered with paint prior to testing, have demonstrated by substantially complete wear-induced removal of the paint on the surfaces that the PSP 218 maintains intimate, stable and substantially continuous contact with the wall of the borehole, not only during entry of PSP 218 into the pilot hole but also thereafter during the hole-opening process.

Referring now to FIGS. 8 through 12 of the drawings, a second aspect of the present invention will be discussed. FIG. 8 depicts a steerable bottomhole reaming assembly 310, including an RWD tool 100 and pilot bit 250 combination as depicted in FIG. 7, generally referred to by reference numeral 320. Above RWD tool 100, an eccentric stabilizer 330 is placed on the bearing housing of downhole motor 350, bent housing 340 lying immediately above stabilizer 330, which is oriented away from the direction of build of the curve of the borehole 300. Above motor 350 lies another eccentric stabilizer 500, rotationally aligned with stabilizer 330 on the outside of the curve of the borehole path. Such an arrangement provides superior stability during the angle-build and holding phases of directional drilling when reaming of the borehole is conducted.

Figure 1:
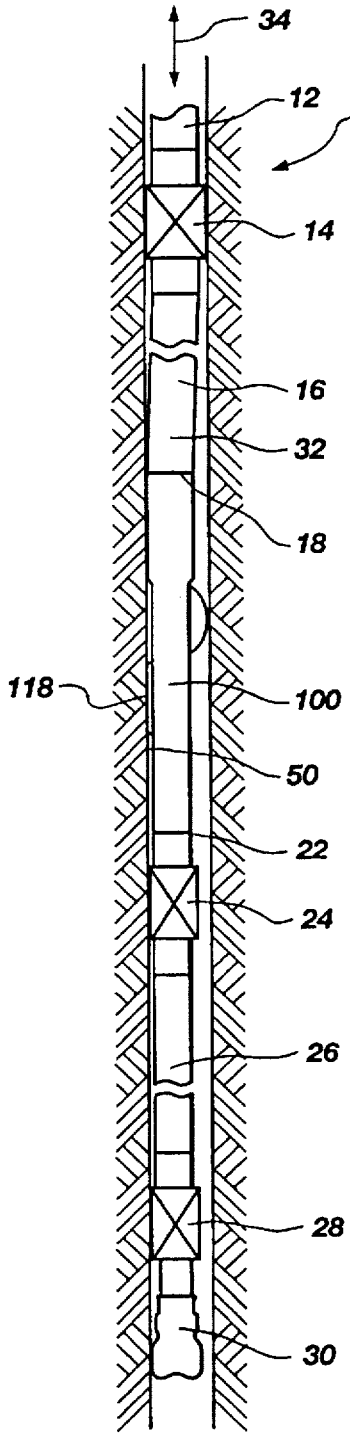
Fig. 1 (PRIOR ART)
FIGS. 1 through 3 comprise schematic partial sectional elevations of a prior art bottomhole assembly including a reamer wing or RWD tool, the bottomhole assembly being shown in pass through condition (FIG. 1), in start up condition (FIG. 2) and in a normal drilling mode for enlarging the borehole (FIG. 3)
Figure 2:
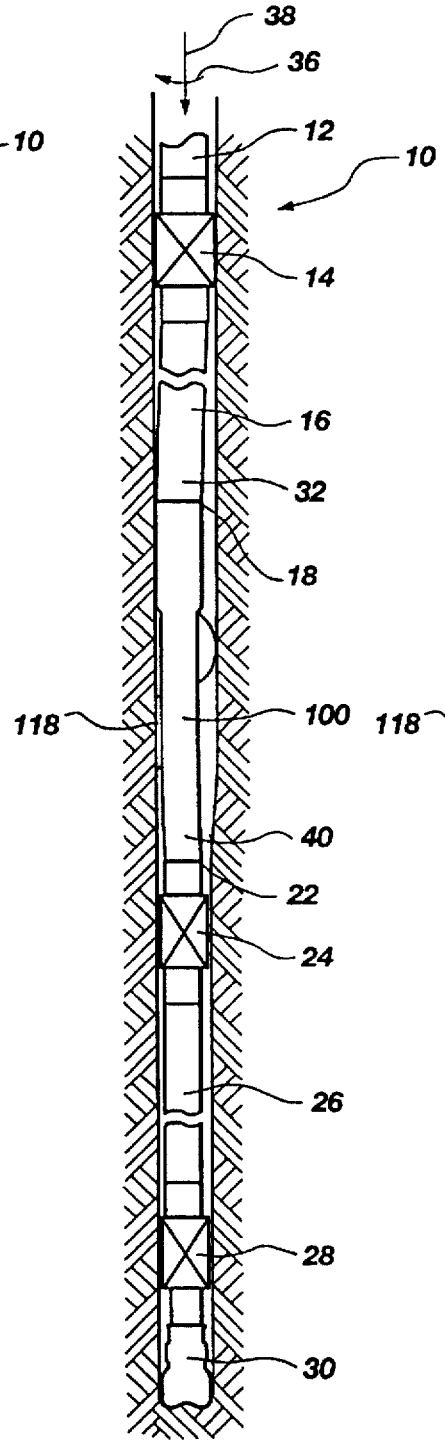
Fig. 2 (PRIOR ART)

FIG. 9 depicts another bottomhole reaming assembly 410 for non-steerable drilling, typically as when drill string rotation is effected solely by a rotary table or top drive. It will be appreciated that assembly 410 is substantially similar to assembly 10 of FIGS. 1–3, employing a pilot bit 30 (which may comprise a drag bit or rock bit, as previously noted) with two concentric pilot hole stabilizers 24 and 28 thereabove and below RWD tool 100. However, unlike assembly 10, assembly 410 employs three longitudinally-spaced eccentric stabilizers 500, rotationally offset at substantially 120° intervals as shown in FIG. 10, and with drill pipe or drill collars interposed therebetween. Thus, while the eccentricity of stabilizers 500 and their wide longitudinal spacing (and attendant string flex) provides ready movement through the pass through diameter of the borehole, once assembly 410 is rotated, as by rotary table or top drive, the assembly is radially stabilized by the rotationally offset eccentric stabilizers, preventing "whip" of the string. It is also contemplated that only two, or more than three, stabilizers may be employed, and that rotational offsets of two or more stabilizers employed according to the invention may be equal or unequal.

It is contemplated that additional, rotationally offset eccentric stabilizers 500 as shown in broken lines in FIG. 8 may also be employed in bottomhole assembly 310 above the single stabilizer 500 previously described. The only constraint on longitudinal spacing of stabilizers 500, if more than one is employed, is enough distance therebetween so that the intervening drill pipe or drill collars provide adequate lateral flex to permit sequential passage of the stabilizers through the pass through diameter of the borehole. If the steerable assembly is one in which large intervals of straight borehole are to be drilled and reamed, it is more likely that such additional stabilizers will be employed than if the assembly is primarily employed to build angle in the borehole. In such an instance, the entire string is rotated for straight drilling, thus rendering it susceptible to the aforementioned "whip" phenomenon, and making use of multiple, rotationally offset eccentric stabilizers above the motor more desirable.

Figure 11:
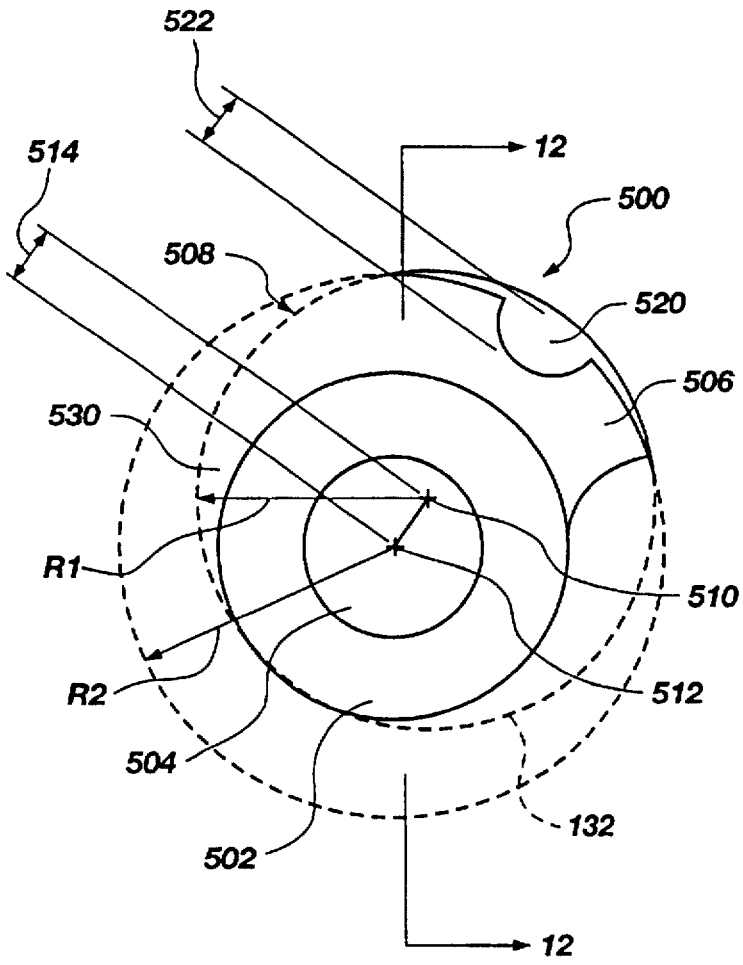
FIG. 11 is a bottom view of an exemplary eccentric stabilizer in accordance with the present invention.
Figure 12:
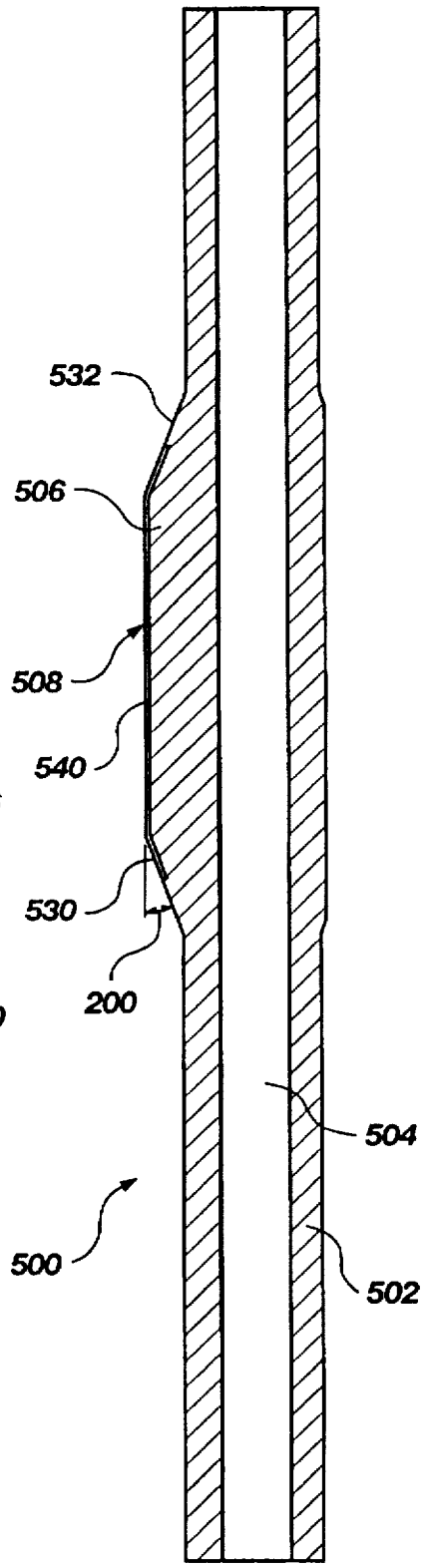
FIG. 12 is a side sectional elevation of the stabilizer of FIG. 11, taken along line 12—12.

Referring now to FIGS. 11 and 12, an exemplary eccentric stabilizer 500 according to the present invention is depicted.

Stabilizer 500 includes a tubular body 502 having a bore 504 therethrough for passage of drilling fluid. Typically, one end of stabilizer has a pin thread and the other a box, for connection to drill pipe or drill collars above and below the stabilizer, such features having been omitted from the drawings as well known in the art and unnecessary to the description of the invention. Eccentric stabilizer blade 506 is mounted to or integrally formed on body 502, and defines an arcuate side bearing surface 508 of greater radius RI than that of body 502, but slightly smaller than the pass through diameter 132 of the borehole. As shown, the center 510 of the arc of surface 508 is laterally offset from the centerline 512 of body 502 by a distance 514, so that when rotation is commenced bearing surface 508 will easily slide along the borehole wall and ride up on its trailing portion of the bearing surface 508. Thus, when the string in which stabilizer 500 is incorporated is constantly rotated during a reaming operation opening the hole to drill diameter, depicted in FIG. 11 as having radius R2, the trailing portion of surface 508 will slide along the borehole wall, centering the drill string.

Longitudinal junk slot 520, of arcuate cross section and depth 522, provides additional cross-sectional area for movement of drilling fluid up the borehole annulus. The junk slot may comprise another cross-sectional configuration such as triangular or rectangular, and more than one junk slot may be employed as required or desired to enhance flow areas.

As with PSP 218, stabilizer 500 employs a longitudinally-tapered entry surface 530 below and contiguous with longitudinal side bearing surface 508, entry surface 530 (unlike entry surface 226) being provided primarily to ease passage of stabilizer 500 through tight spots and dog-legs in the borehole, and serves no specific function once stabilizer 500 is in an opened portion of the borehole. The taper angle, relative to the longitudinal axis of body 502, is currently believed to be preferably about 20°, as shown in FIG. 12, although taper angles of 10° to 45° are contemplated as having utility in the invention. Stabilizer 500 is also preferably provided with an upper, exit surface 532 of like taper to surface 530, to facilitate tripping of stabilizer 500 out of the borehole. Further, since wear of the bearing surface 508 and entry and exit surfaces 530 and 532, respectively, is undesirable, hardfacing as previously described is preferably applied in area 540 (see FIG. 12) of blade 506.

Many other additions, deletions and modifications of the invention as described and illustrated herein may be made without departing from the scope of the invention as hereinafter claimed.

What is claimed is:

1. A pilot stabilizer pad for use with a rotatable reaming assembly disposed thereabove for enlarging a pilot borehole, said reaming assembly generating a resultant, directed lateral force vector and said pad being rotationally located to bear against a wall of said pilot borehole under said force vector and comprising:

a circumferentially-extending arcuate transition surface of increasing radius, relative to a center point, between a leading circumferential edge thereof and a trailing circumferential portion thereof, taken in the direction of rotation.

2. The apparatus of claim 1, wherein said arcuate transition surface increases in radius to said trailing portion, and thereafter maintains a substantially constant radius.

3. The apparatus of claim 2, wherein said center point comprises a center point of a tool body from which said pad projects.

4. The apparatus of claim 1, wherein said circumferentially-extending transition surface is oriented substantially parallel to a longitudinal axis of said reaming assembly.

5. The apparatus of claim 1, further including a circumferentially-extending entry surface longitudinally below said transition surface, said entry surface having a lower edge of substantially constant radius relative to said center point, and an upper edge of increasing radius, relative to said center point, between a location proximate said leading circumferential edge of said transition surface and a location proximate said trailing circumferential portion thereof.

6. The apparatus of claim 5, wherein said entry surface is oriented at a substantially constant angle about its circumference.

7. The apparatus of claim 5, wherein said entry surface and said transition surface are substantially circumferentially co-extensive.

8. The apparatus of claim 5, wherein said entry surface and said transition surface are substantially contiguous.

9. The apparatus of claim 8, wherein said entry surface and said transition surface are substantially circumferentially co-extensive and substantially contiguous throughout their mutual circumferential extent.

10. The apparatus of claim 1, wherein said pad is mounted to a body located immediately below said reaming assembly, said body including a longitudinal bore therethrough.

11. A rotatable reaming assembly for enlarging a pilot borehole, comprising:

a pilot bit for drilling said pilot borehole;

a reaming tool above said pilot bit, said reaming tool including fixed cutting structure configured and arranged to enlarge a pilot borehole to a drill diameter, and to generate a resultant, directed lateral force vector during rotation of said reaming tool; and a pilot stabilizer pad disposed below said cutting structure of said reaming tool, said pad being located to bear against a wall of said pilot borehole under said force vector, said pad including a circumferentially-extending arcuate transition surface of increasing radius, relative to a center point, between a leading circumferential edge thereof to a trailing circumferential portion thereof, taken in the direction of rotation.

12. The apparatus of claim 11, wherein said arcuate transition surface increases in radius to said trailing portion, and thereafter maintains a substantially constant radius.

13. The apparatus of claim 12, wherein said center point comprises a center point of a tool body from which said pad projects.

14. The apparatus of claim 11, wherein said circumferentially-extending transition surface is oriented substantially parallel to a longitudinal axis of said reaming assembly.

15. The apparatus of claim 11, further including a circumferentially-extending entry surface longitudinally below said transition surface, said entry surface having a lower edge of substantially constant radius relative to said center point, and an upper edge of increasing radius, relative to said center point, between a location proximate said leading circumferential edge of said transition surface and a location proximate said trailing circumferential portion thereof.

16. The apparatus of claim 15, wherein said entry surface is oriented at a substantially constant angle about its circumference.

17. The apparatus of claim 15, wherein said entry surface and said transition surface are substantially circumferentially co-extensive.

18. The apparatus of claim 15, wherein said entry surface and said transition surface are substantially contiguous.

19. The apparatus of claim 18, wherein said entry surface and said transition surface are substantially circumferentially co-extensive and substantially contiguous throughout their mutual circumferential extent.

20. The apparatus of claim 19, wherein said pad is mounted to a body located immediately below said cutting structure, said body including a longitudinal bore therethrough.

21. The apparatus of claim 20, wherein said cutting structure and said pad are mounted to a common body.

22. A reaming assembly for enlarging a pilot borehole to a drill diameter, comprising:

a pilot bit;

a reaming tool above said pilot bit; and at least one eccentric stabilizer above said reaming tool.

23. The apparatus of claim 22, wherein said at least one eccentric stabilizer comprises a plurality of longitudinally spaced eccentric stabilizers.

24. The apparatus of claim 23, wherein at least two of said eccentric stabilizers are mutually rotationally offset.

25. The apparatus of claim 23, wherein said plurality of eccentric stabilizers comprises at least three eccentric stabilizers, mutually rotationally offset by substantially 120 degrees.

26. The apparatus of claim 22, further including a downhole motor for rotating said pilot bit and said reaming tool, said at least one eccentric stabilizer being disposed above said motor.

27. The apparatus of claim 26, further including another eccentric stabilizer disposed between said motor and said reaming tool.

28. The apparatus of claim 27, wherein said eccentric stabilizers are substantially rotationally aligned.

29. The apparatus of claim 27, further including additional eccentric stabilizers above said motor, said stabilizers above said motor being longitudinally spaced and mutually rotationally offset.

30. An eccentric stabilizer for use with a reaming assembly for enlarging a borehole, said stabilizer comprising:

a tubular body including a longitudinal bore therethrough and;

a stabilizer blade mounted to said tubular body and including a circumferentially-extending arcuate bearing surface of increasing radius, relative to a first center point, between a leading circumferential edge thereof and a trailing circumferential portion thereof, taken in the direction of rotation.

31. The apparatus of claim 30, wherein said first center point comprises a longitudinal axis of said body.

32. The apparatus of claim 31, wherein said bearing surface comprises a substantially constant radius with respect to a second center point laterally offset from said body center point.

33. The apparatus of claim 32, wherein said constant radius is slightly smaller than a radius through which said stabilizer is to longitudinally pass.

34. The apparatus of claim 30, wherein said trailing circumferential portion of said bearing surface is adapted to bear, during rotation thereof, against a wall of said enlarged borehole and about said first center point.

35. The apparatus of claim 30, further including at least one longitudinally-extending junk slot located in said trailing portion of said bearing surface.

36. The apparatus of claim 35, wherein said junk slot is of arcuate transverse cross-section.

37. The apparatus of claim 30, wherein said arcuate bearing surface increases in radius to said trailing portion, and thereafter maintains a substantially constant radius.

38. The apparatus of claim 30, wherein said circumferentially-extending bearing surface is oriented substantially parallel to a longitudinal axis of said reaming assembly.

39. The apparatus of claim 38, further including a circumferentially-extending entry surface longitudinally below said bearing surface, said entry surface having a lower edge of substantially constant radius relative to said center point, and an upper edge of increasing radius, relative to said center point, between a location proximate said leading circumferential edge of said bearing surface and a location proximate said trailing circumferential portion thereof.

40. The apparatus of claim 39, wherein said entry surface is oriented at a substantially constant angle about its circumference.

41. The apparatus of claim 39, wherein said entry surface and said bearing surface are substantially circumferentially co-extensive.

42. The apparatus of claim 39, wherein said entry surface and said bearing surface are substantially contiguous.

43. The apparatus of claim 42, wherein said entry surface and said bearing surface are substantially circumferentially co-extensive and substantially contiguous throughout their mutual circumferential extent.

44. The apparatus of claim 38, further including a circumferentially-extending exit surface longitudinally above said bearing surface, said exit surface having an upper edge of substantially constant radius relative to said center point, and a lower edge of increasing radius, relative to said center point, between a location proximate said leading circumferential edge of said bearing surface and a location proximate said trailing circumferential portion thereof.

45. The apparatus of claim 44, wherein said exit surface is oriented at a substantially constant angle about its circumference.

46. The apparatus of claim 44, wherein said exit surface and said bearing surface are substantially circumferentially co-extensive.

47. The apparatus of claim 44, wherein said exit surface and said bearing surface are substantially contiguous.

48. The apparatus of claim 47, wherein said exit surface and said bearing surface are substantially circumferentially co-extensive and substantially contiguous throughout their mutual circumferential extent.

* * * * *

UNITED STATES PATENT AND TRADEMARK OFFICE

CERTIFICATE OF CORRECTION

PATENT NO. : 5,765,653

DATED : June 16, 1998

INVENTOR(S) : Doster et al.

It is certified that error appears in the above-identified patent and that said Letters Patent is hereby corrected as shown below:

ON THE COVER PAGE:

Under item "[56] References Cited" add a new heading titled --FOREIGN PATENT DOCUMENTS-- and beneath the new heading add --0 058 061 A2 08/1982 EP--;

Under item "[57] Abstract", line 4, change "above" to --thereabove--;

Under item "[57] Abstract", line 6, change "accommodated" to --accommodating--.

In column 1, line 10, delete the comma after "borehole" and insert commas after "and" and "specifically";

In column 1, line 15, delete the comma after "smaller";

In column 2, line 3, change "superhard)" to --"superhard")--;

In column 2, line 7, after "smaller" insert --radius--;

In column 3, line 52, change "start up" to --start-up--;

In column 4, line 16, change "enlarge" to --enlarged--;

In column 4, line 42, insert a comma after "contiguous";

In column 4, line 43, insert a comma after "tapered";

In column 5, line 20, change "start up" to --start-up--;

In column 5, line 61, after "therethrough" and before the comma, insert --on centerline 120 thereof--;

In column 6, line 2, after "PSP" insert --218--;

In column 6, line 3, insert a period after "219" and thereafter delete "while the trailing portion 224";

In column 6, line 4, delete this line in its entirety;

In column 6, line 5, delete "120 of tool body 102. In any case,";

In column 6, line 5, change "transition" to --Transition--;

In column 6, line 7, after "leading" change "edge" to --portion-- and after "220" insert --extending across trailing portion 224--;

In column 6, line 10, change "228" to --226--;

In column 6, line 30, change "axial" to --concentric--;

In column 6, line 31, after "such as" insert --assembly--;

UNITED STATES PATENT AND TRADEMARK OFFICE

CERTIFICATE OF CORRECTION

PATENT NO. : 5,765,653
DATED : June 16, 1998
INVENTOR(S) : Doster et al.

It is certified that error appears in the above-identified patent and that said Letters Patent is hereby corrected as shown below:

In column 6, line 61, after "is" delete "of";
In column 6, line 65, change "start up" to --start-up--;
In column 7, line 15, after "smooth" insert --a--;
In column 7, line 24, change "130" to --131--;
In column 7, line 29, change "130" to --131--;
In column 7, line 32, change "FIG. 5" to --FIG. 6-- and insert a comma after "rotation";
In column 7, line 46, change "or" to --nor--;
In column 7, line 58, insert commas after "although" and "noted";
In column 9, line 3, after "stabilizer" insert --500--;
In column 9, line 12, after "arc of" insert --bearing--;
In column 9, line 14, insert a comma after "commenced";
In column 9, line 18, insert a comma after "operation";
In column 9, line 20, before "surface" insert --bearing--;
In column 9, line 34, change "serves" to --serving--;
In column 9, line 60, after "in" change "the" to --a--;
In column 9, line 63, after "trailing" insert --circumferential--;
In column 10, line 2, delete "circumferentially-extending" and insert --arcuate--;
In column 10, line 7, after "said" insert --arcuate--; line 10, after "said" insert --arcuate--; and line 12, delete "thereof" and insert --of said arcuate transition surface--;
In column 10, line 17, before "transition" insert --arcuate--;
In column 10, line 20, before "transition" insert --arcuate--;
In column 10, line 22, before "transition" insert --arcuate--;
In column 10, line 33, after "enlarge" delete "a" and insert --said--; line 41, after "thereof" delete "to" and insert --and--; and line 42, after "in" delete "the" and insert --a--;
In column 10, line 44, after "trailing" insert --circumferential--;
In column 10, line 50, delete "circumferentially-extending" and insert --arcuate--;
In column 10, line 55, after "said" insert --arcuate--; line 59, after "said" insert --arcuate--; and line 61, delete "thereof" and insert --of said arcuate transition surface--;
In column 10, line 66, after "said" insert --arcuate--;
In column 11, line 2, after "said" insert --arcuate--;
In column 11, line 4, after "said" insert --arcuate--;
In column 11, line 22, after "said" insert --plurality of--;
In column 11, line 34, after "said" insert --at least one and said another--;

UNITED STATES PATENT AND TRADEMARK OFFICE

CERTIFICATE OF CORRECTION

PATENT NO. : 5,765,653

DATED : June 16, 1998

INVENTOR(S) : Doster et al.

It is certified that error appears in the above-identified patent and that said Letters Patent is hereby corrected as shown below:

In column 11, line 37, before "stabilizers" (2nd occurrence), insert --additional--;
In column 11, line 50, change "the" to --a--;
In column 11, line 52, after "said" insert --tubular--;
In column 11, line 56, change "body" to --first--;
In column 12, line 7, after "trailing" insert --circumferential--;
In column 12, line 11, after "trailing" insert --circumferential--;
In column 12, line 15, delete "circumferentially-extending" and insert --arcuate--;
In column 12, line 21, after "said" insert --first--; line 22, after "said" insert --first--; and line 25, delete "thereof" and insert --of said bearing surface--;
In column 12, line 41, after "said" insert --first--; line 42, after "said" insert --first--; and line 45, delete "thereof" and insert --of said bearing surface--.

Signed and Sealed this

Thirtieth Day of November, 1999

*Attest:*

*Attesting Officer*

Q. TODD DICKINSON

*Acting Commissioner of Patents and Trademarks*